United States Patent [19]

Collic, Sr.

[11] 4,261,280

[45] Apr. 14, 1981

[54] CLAMP AND HOOK ARRANGEMENT AND ATTACHMENT FOR BOAT HOOKS USED IN DOCKING

[76] Inventor: Edward H. Collic, Sr., 3706 Marmon Ave., Baltimore, Md. 21267

[21] Appl. No.: 103,555

[22] Filed: Dec. 14, 1979

[51] Int. Cl.[3] ..... B63B 21/04

[52] U.S. Cl. ..... 114/221 R; 114/230; 294/19 R; 119/153

[58] Field of Search ..... 294/19 R, 19 A, 83; 114/221 R, 230; 119/151, 153, 154; 9/14; 83/5

[56] References Cited

U.S. PATENT DOCUMENTS

| | | | |
|---|---|---|---|
| 3,677,597 | 7/1972 | Stipek | 294/19 R |
| 3,918,385 | 11/1975 | Wallace | 294/19 R |
| 3,945,335 | 3/1976 | Kratz | 294/19 P |

*Primary Examiner*—James B. Marbert

*Attorney, Agent, or Firm*—George R. Douglas, Jr.

[57] ABSTRACT

A boat line handling device attachable to a boat hook or like instrument comprised of a length of resilient, strong wire such as aluminum having its end section or length of sufficient dimension for turning into a pair of approximately two inch (2") loops, diametrically measured, and having the end portion for gathering and tying the loops together where the loop wire adjoins a straight segment, the straight segments joined by the common length of wire and having near one intermediate end a turn of wire forming a pole eye for receiving an end of a boat hook and the straight segment near the other end contoured to form a pole hook member to rest over the boat hook in a generally parallel relation while in use, the loops being used for receiving in resiliency relation a boat line for handling and passing a securing line from a boat to a piling, mooring cleat, and the like.

6 Claims, 2 Drawing Figures

CLAMP AND HOOK ARRANGEMENT AND ATTACHMENT FOR BOAT HOOKS USED IN DOCKING

CROSS-REFERENCE TO PRIOR NON-RELEVANT ART AND REFERENCES

The present invention is an improvement over each of the prior non-relevant art and references as follows:

| U.S. Pat. No. | Inventor |
|---|---|
| 2,811,127 | Palson |
| 3,828,716 | Bernardi |
| 3,841,685 | Kolodziej |
| 3,918,385 | Wallace |
| 3,945,335 | Kratz |
| 4,004,539 | Wesson |

which are found from a search in Class 114, subclass 97, 221R and 230; and Class 294, subclass 82 and 19R. None of these prior patents are seen to anticipate the invention.

BRIEF SUMMARY OF THE INVENTION

The present invention relates to an improved clamp and hook arrangement for use with boat hooks and like devices, and more particularly the invention is directed to a rigid wire element of a given sufficient long length having ends formed into at least two loop turns and having an end section twisted to form a gathered of said loop turns, said loop turns connected by a single length of said rigid wire element with a pole eye near one end and a pole hook member near the other.

It is found that there are no prior references, devices on the market, or other conceptual features known to the public that improve boat line handling or devices for use in docking, mooring boats or for facilitating the securing of a boat line to a mooring connection, such as a post, piling, cleat, and the like and in which the use or operation of which does not require extended and developed skill on part of the user that is to perform a boat line handling function.

Another facet of the summary provides that the device is wear resistant, capable for use near and about salt water, and does not interfere with normal storage of the associated line or of the device itself.

BACKGROUND OF THE INVENTION

There have been numerous and extensive means developed and marketed in the art of small boat handling of mooring lines that have moving parts, that are required to be maintained by cleanliness, lubrication or other treatments.

A further object, advantage and benefit of the present invention is that there is provided a device attachment for boat hooks of a character uniquely adapted for docking of customary sized small boats using a conventional boat hook so that the docking function and operation is accomplished with equipment readily available and capable of being stored on such a small boat without undue size characteristics thereof.

Another object and function of the device of the invention is to provide a device attachment which is readily affixable upon a conventional boat hook without requiring modification thereof and in which the device attachment is small and easily stored on board the small boat.

Another advantage and concept of the invention is that it provides a mechanical simplistic structure without increasing their cost and weight for use in docking and mooring purposes of small boats.

According to a further object and advantage of the present invention there is provided a more dependable method and apparatus attachment that allows for a mooring line to be passed onto a piling, mooring cleat, or other device as desired.

BRIEF DESCRIPTION OF THE SEVERAL VIEWS OF THE DRAWINGS

The above and other objects and advantages of the invention will become apparent upon full consideration of the following detailed description and accompanying drawings in which.

DETAILED DESCRIPTION OF THE PREFERRED EMBODIMENT OF THE INVENTION

Figure 1:
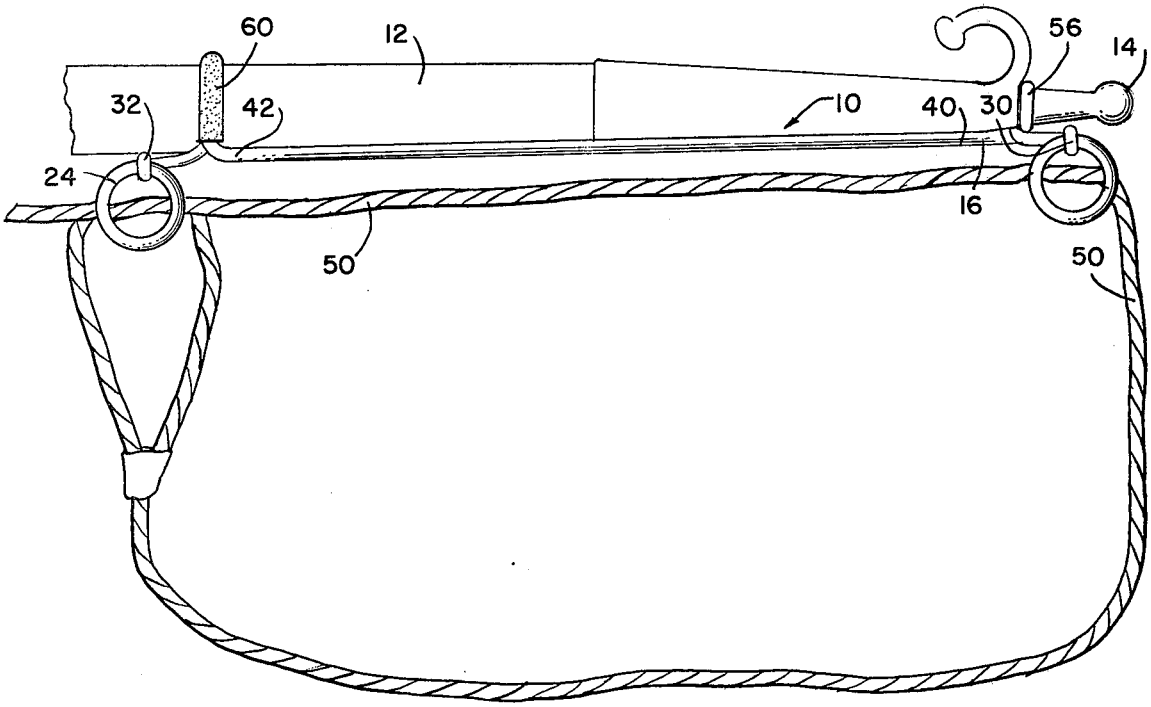
FIG. 1 is a side elevation view of the device shown attached to a conventional boat hook shown in phantom, according to a preferred and best mode of the present invention.
Figure 2:
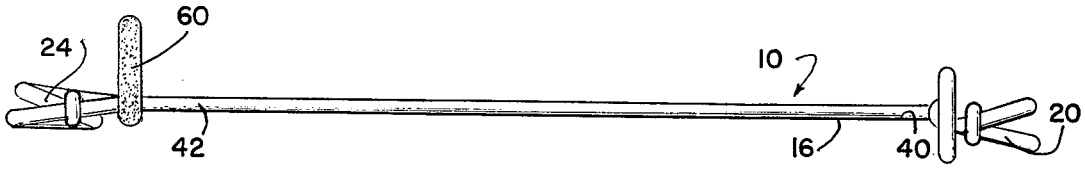
FIG. 2 is a cross sectional view taken along line 2—2 of FIG. 1.

Referring now to the drawings there is shown a line clamp and boat hook attachment 10, a boat hook 12 and a pole end 14 of the boat hook. The line clamp and boat hook attachment 10 is seen comprised of a generally rigid wire element 16 of a metal such as aluminum and the like and it is seen to be worked so that at a given length it is generally straight as illustrated terminating in at least two complete loops 20, 24 and having terminal sections 30, 32 at each of the free ends twisted to form a gathering at a point of each of the two loops where it meets straight portion 40, 42. The said two complete loops 20, 24 each are constructed of the material such as aluminum so that they have sufficient resiliency so that a boat line 50 can be securely and snugly received between the pairs of each of the loops 20, 24, allowing the loops to be worked with when the attachment 10 is in use as to be described.

Near one of the ends or straight end 40 there is provided a circular turn of wire element 16 forming a pole eye 56 and the other end 42 has a portion of the wire element 16 forming a pole hook 60 and for receiving within the open hook portion thereof an intermediate part of a boat hook 12. The boat hook end 14 is inserted through the pole eye 56 as illustratively suggested and shown. Surrounding the pole hook 60 and perhaps the pole eye 56, if desired, there is a covering of soft rubber tape for allowing the line clamp and boat hook attachment 10 to be generally held fast onto the boat hook 12.

It is seen that by means of the present invention the line clamp and boat hook attachment 10 having the clamp or loops 20, 24 for clamping onto the line 50 as illustrated and in which the boat hook end 14 projects through a pole line 56 and the pole hook 60 is secured onto the shaft or intermediate portion of the boat hook 12, there is provided a new apparatus that enables the user to drop a loop or other portion of the line 50 over a piling or mooring cleat. Such a loop 70 is illustratively shown by means and method of the present invention. A practice of the device eliminates having to throw the line at people or other uncertain objects when the water is rough and the throwing accuracy is not defined and without the probability of missing a given target such as a mooring, pole or cleat. The C-shaped hook 60 is seen to rest over an intermediate or shaft portion of the boat hook 12 enabling a user to drop the loop 70 with ease over a piling, mooring cleat or other device without having to aimlessly or aimfully with some disparagence of accuracy being thrown onto a misdirected object.

It is seen by the practice of the present invention as embodied and disclosed in the preferred and best mode described generally herein that a device is provided for augmenting use of small boats as well as providing a device that does not seem to be cumbersome, obtuse, but is easily attached to a boat hook which is a well known boat tool.

Additional embodiments of the invention in this specification will occur to others and therefore it is intended that the scope of the invention be limited only by the appended claims and not by the embodiments described hereinabove. Accordingly, reference should be made to the following claims in determining the full scope of the invention.

What is claimed is:

1. A clamp and hook arrangement and attachment for boat hooks used in docking comprising a generally rigid wire element of a given long length having ends with at least two complete loops of said wire element and having terminal section at each ends, said terminal section of said ends twisted to form a gathering at a point of each of said two complete loops and forming a remainder of said loop thereof being free of said gathering but of sufficient resiliency so that a boat line can be securely received within one or more of the two complete loops, the generally rigid wire element connecting the ends disposed so that near one of the ends is a circular turn of the wire element forming a pole eye for receiving an end of a boat hook and near the other end is a pole hook member formed of the wire element resting over the boat hook, the attachment enabling a user to drop a free end of a boat line held secured and received within the two complete loops and then passed over a piling, a cleat and the like without having to throw the boat line.

2. The invention of claim 1 wherein the wire element is of an aluminum type of wire.

3. The invention of claim 1 wherein an elastomeric sheet or tape molding such as soft rubber material is disposed over and around the pole hook member.

4. The invention of claim 3 wherein the soft rubber material enables and aids a user to have the attachment to hold fast onto a pole section of said boat hook.

5. The invention of claim 1 wherein the overall length of the attachment for boat hooks is about twenty inches (20").

6. The invention of claim 1 wherein said boat eye and said pole hook member have an overall outside diameter of generally two inches (2").

* * * * *